US005181289A

United States Patent [19]

Kassai

[11] Patent Number: 5,181,289

[45] Date of Patent: Jan. 26, 1993

[54] BED APPARATUS AND REHABILITATION ATTACHMENT

[76] Inventor: Kenzou Kassai, 14-9, Higashishinsaibashi 1-chome, Chuo-ku, Osaka, Japan

[21] Appl. No.: 849,727

[22] Filed: Mar. 12, 1992

[30] Foreign Application Priority Data

Mar. 15, 1991 [JP] Japan ..... 3-51738

[51] Int. Cl.[5] ..... A61G 7/00; A61G 7/14

[52] U.S. Cl. ..... 5/612; 5/81.1; 5/662; 5/83.1; 5/658; 482/133; 482/142; 482/904

[58] Field of Search ..... 5/600, 612, 662, 658, 5/81.1, 83.1, 84.1; 482/133, 142, 904

[56] References Cited

U.S. PATENT DOCUMENTS 1,699,026 1/1929 Schumacher et al. ..... 5/662
2,928,675 3/1960 Nawara ..... 482/133
3,077,613 2/1963 Mayer ..... 5/662
4,826,490 7/1974 Mossman ..... 482/133

FOREIGN PATENT DOCUMENTS 2-215462 8/1990 Japan ..... 5/612

*Primary Examiner*—Alexander Grosz
*Attorney, Agent, or Firm*—W. G. Fasse

[57] ABSTRACT

A bed apparatus having a lifting mechanism including sliders, upright bars, support members and side bars, is equipped with a coupling rail above the side bars to be vertically movable with the side bars. A rehabilitation attachment with a pulley is movably mounted on the rail. A rope is extended around the pulley so that a sick person or the like can alternately pull the ends of the rope with the left and right hand for exercising the hands and arms. The person's feet may be connected to one end of the rope while pulling the other end of the rope with the hands for exercising the person's limbs.

5 Claims, 18 Drawing Sheets

BED APPARATUS AND REHABILITATION ATTACHMENT

FIELD OF THE INVENTION

The present invention relates to a bed apparatus which comprises a mechanism for rehabilitation and a rehabilitation attachment which is combined with such a bed apparatus, and more particularly, it relates to a bed apparatus and a rehabilitation attachment which are suitable for a sick person, a physically handicapped person or a bed-ridden person (hereinafter simply referred to as "sick person or the like") who is nursed at home, for example.

BACKGROUND INFORMATION

The inventor has proposed an improved bed apparatus in U.S. patent application No. 755,448, filed Sept. 5, 1991 (Kassai). In consideration of housing circumstances in Japan, this bed apparatus can be used in a 6-mat room of about 270 cm by 360 cm or a 4.5-mat room of about 270 cm by 270 cm, for example. The bed in the copending application is provided with a lifting mechanism which can simply raise up or lay down a sick person or the like from or on the bed body and move the person onto a side portion of the bed body.

A bed-ridden state is rather unpreferable for a sick person or the like to recover from illness or disorder. In recent years, the importance of rehabilitation has been recognized in particular, and many reports have been written on the fact that it is rather advisable for a sick person or the like to exercise however lightly, in order to recover sooner.

SUMMARY OF THE INVENTION

Accordingly, it is an object of the present invention to provide a bed apparatus which has the aforementioned lifting mechanism and enables the rehabilitation of a sick person or the like by the use of parts of such a lifting mechanism and a rehabilitation attachment which is mounted on the bed apparatus.

The present invention is first directed to a bed apparatus having a lifting mechanism, which comprises: a bed body having a longitudinal dimension and a cross-directional dimension, a pair of sliders which is slidably mounted on both end portions of the bed body for a sliding movement along or in parallel to the cross direction of the bed body, whereby the sliders are extending in the cross direction of the bed body.

A pair of upright bars which are mounted on the respective sliders to extend upwardly from the sliders, a pair of support members is mounted on the upright bars and movable or adjustable along the upright bars and stoppable in adjusted positions, and a pair of parallel side bars for coupling the pair of support members with each other.

According to the present invention, such a bed apparatus having a lifting mechanism further comprises a rail coupling the pair of support members with each other, said coupling rail being positioned above the pair of side bars, and a rehabilitation attachment movable along the rail and having a pulley with a central plane rotatable about a vertical axis extending in said central plane.

The rehabilitation attachment comprises: a wheel rolling on a rail, an upper yoke rotatably holding the wheel, a lower yoke which is mounted on the upper yoke to be rotatable about a vertical axis, and a pulley which is rotatably held by the lower yoke.

With the bed apparatus or the rehabilitation attachment according to the present invention, a sick person or the like can exercise the hands, arms and legs.

The rail is brought into a position above the bed body, on which the sick person or the like is laid down, and a rope is extended around the pulley, so that the sick person or the like grasps both end portions of the rope with his left and right hands in a lying state and alternately moves his hands to exercise the hands and arms.

Similarly to the case of the hand and arm exercise, a rope may be extended along the pulley so that the feet or legs of a sick person or the like are secured to an end of the rope while the other end thereof is held by the hands to raise up the feet by moving the hands, thereby exercising the legs in a lying state.

Further, the sick person or the like can exercise by walking with the bed apparatus according to the present invention.

The pair of sliders extend in the cross direction of the bed body and the positions of the sliders are adjusted on the pair of upright bars, so that the sick person or the like can exercise by walking between the two side bars while grasping the same with the hands.

Thus, according to the present invention, it is possible to use the bed apparatus for various purposes by utilizing the lifting mechanism itself for lifting the sick person or the like and mounting the rehabilitation attachment on the bed apparatus so that the bed apparatus fulfills its original function as a bed and the lifting mechanism serves as a lift for the sick person or the like while these components can also be adapted for rehabilitation. Further, such a multifunctional bed apparatus occupies a relatively small space for its functions, whereby the present bed apparatus can be used in an ordinary house, which is generally restricted in space, without any problem.

According to the present invention, it is possible to nurse a sick person or the like in a single bed apparatus over a relatively long period of time in the process of recovery. When the sick person or the like is confined to the bed whether willing or not, the lifting mechanism fulfills its original function for lifting the person for defecation, bathing, change of sheets or the like. In this case, not only the two side bars included in the lifting mechanism but also the rail or the rehabilitation attachment can be used for lifting the sick person or the like when needed. When the sick person or the like has recovered sufficiently that he or she can move the limbs, the person can exercise the hands and limbs with the rehabilitation attachment in the aforementioned modes. When the sick person or the like is ambulatory, further, he or she can exercise by walking in safety while grasping the two side bars which are included in the lifting mechanism.

According to the present invention, the sick person or the like can perform the above hand and limb exercises on the bed body and the walking exercise is performed alongside the bed body. Therefore, the sick person or the like can safely exercise alone, and no particular space is required for such rehabilitation exercise.

It is possible to adjust the rail for holding the rehabilitation attachment which is employed for hand exercises and limb exercises as well as the pair of parallel side bars serving as handrails for the sick person or the like during a walking exercise, to provide the optimum vertical positions for these hand rails with due regard to the situation and the physical constitution of the sick person or the like. In the rehabilitation attachment, the angle of the pulley for receiving the rope, is changeable about a vertical axis, so that the pulley is always at an optimum angle following the direction of extension of the rope, whereby it is possible to prevent the rope from undesirably slipping off the pulley.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 23:
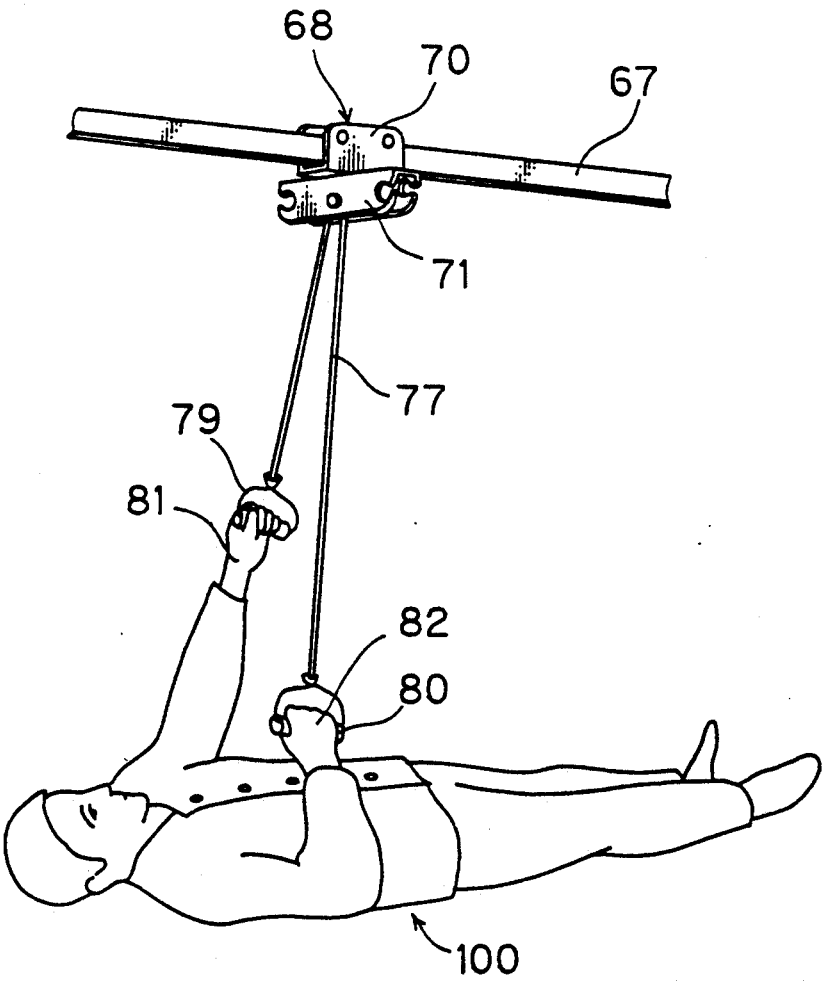
FIG. 23 is a perspective view showing a sick person or the like exercising the hands and arms.
Figure 24:
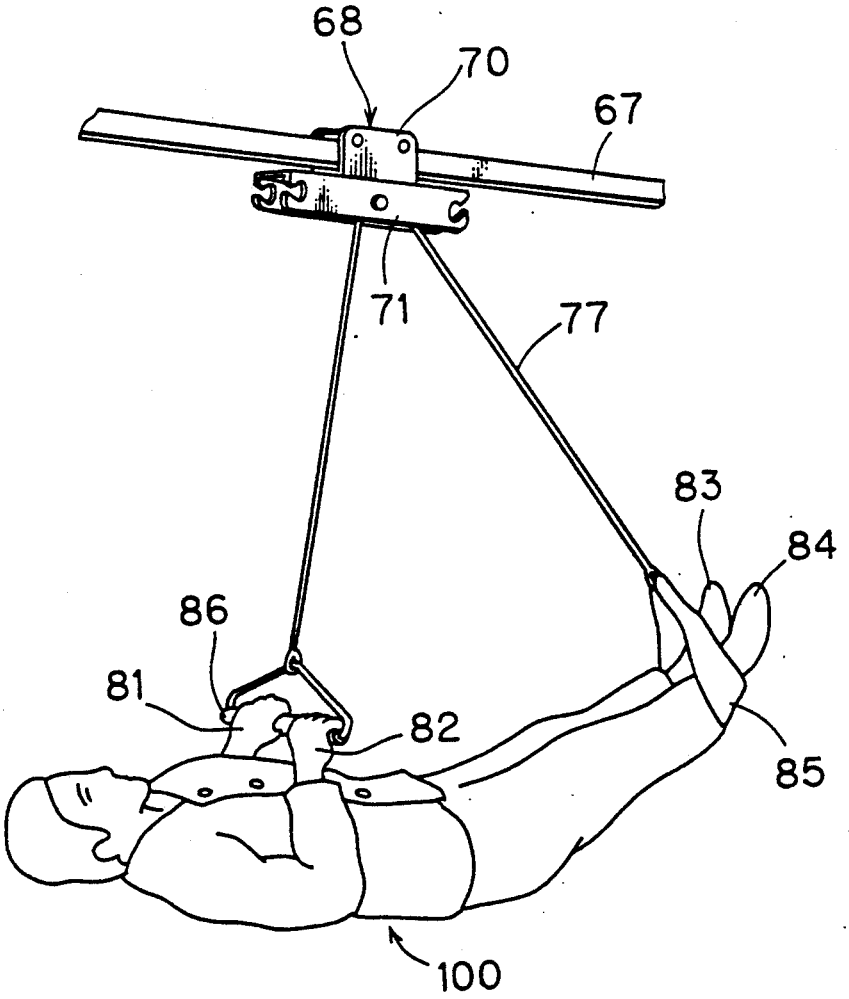
FIG. 24 is a perspective view showing the sick person or the like exercising the legs.
Figure 26:
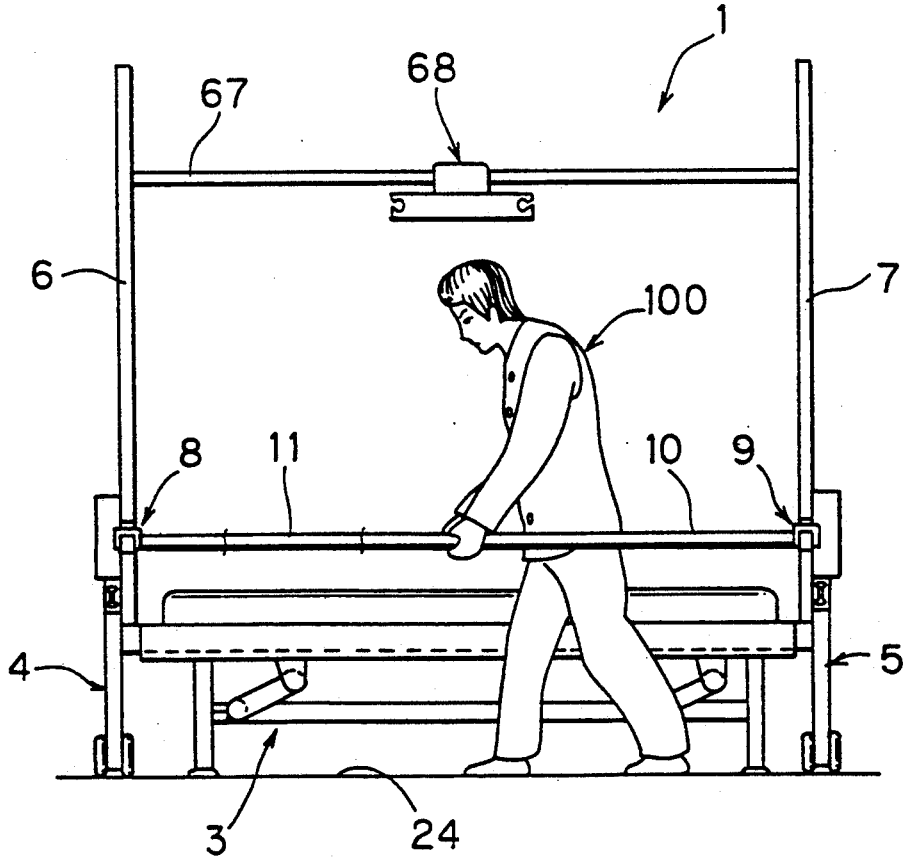
FIG. 26 is a front elevational view showing the sick person or the like exercising by walking with the help of side bars.
Figure 27:
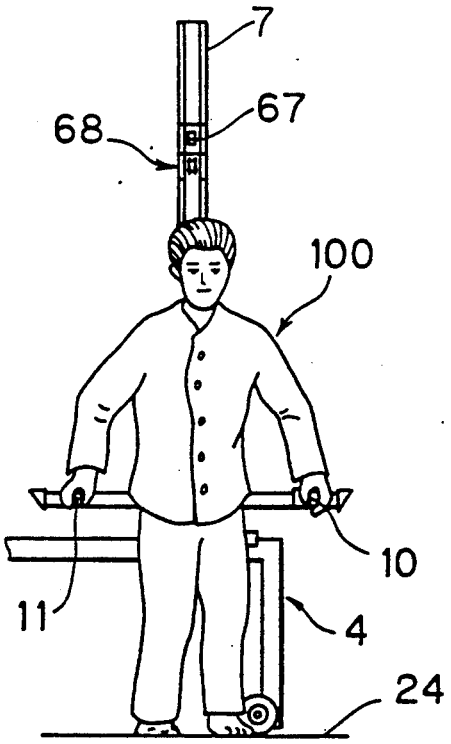
FIG. 27 is a left end elevational view illustrating the state shown in FIG. 26.

As hereinafter described, FIG. 23 shows a sick person or the like performing hand and arm exercises. FIG. 24 shows the sick person or the like performing limb exercises. FIGS. 26 and 27 show the sick person or the like performing walking exercises. Such rehabilitation exercises can be performed with a bed apparatus 1, according to the invention which will now be described in detail.

Figure 1:
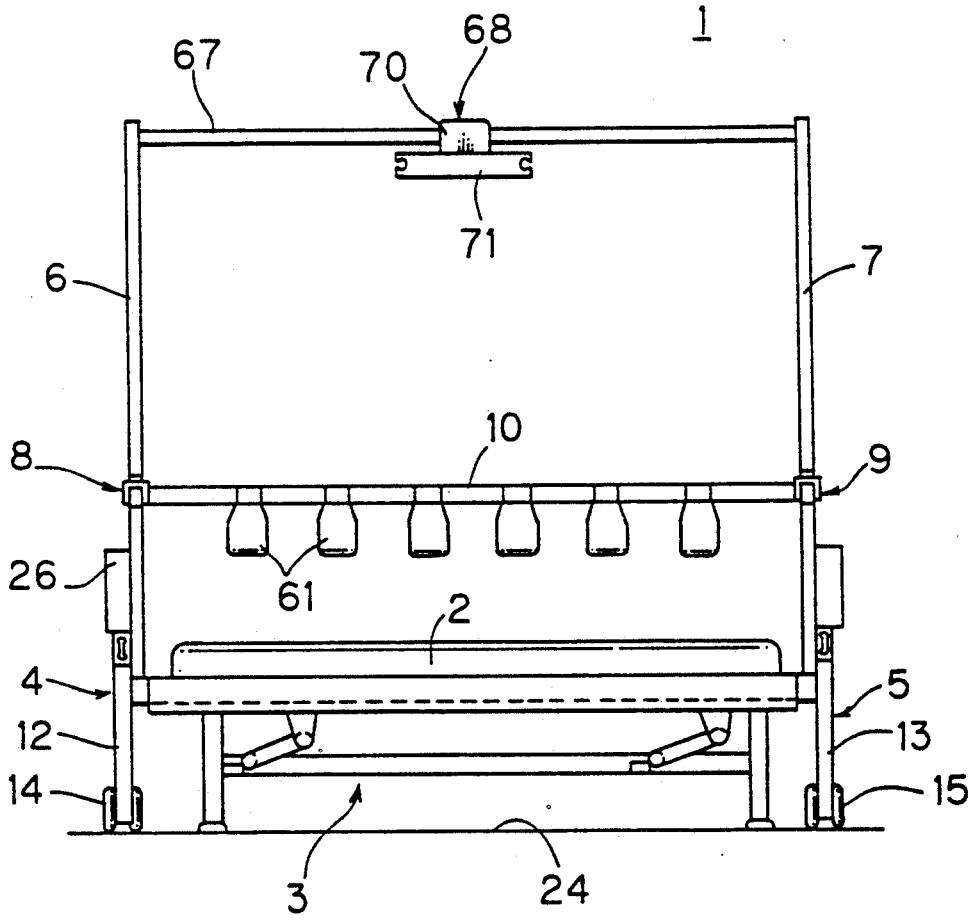
FIG. 1 is a front elevational view showing a bed apparatus according to an embodiment of the present invention.
Figure 2:
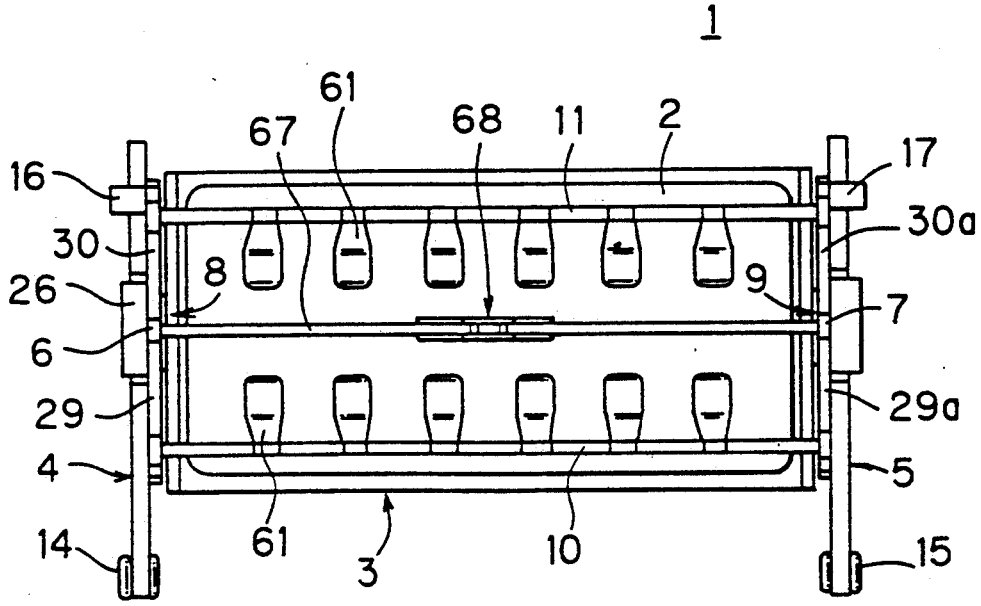
FIG. 2 is a plan view of the bed apparatus shown in FIG. 1.
Figure 3:
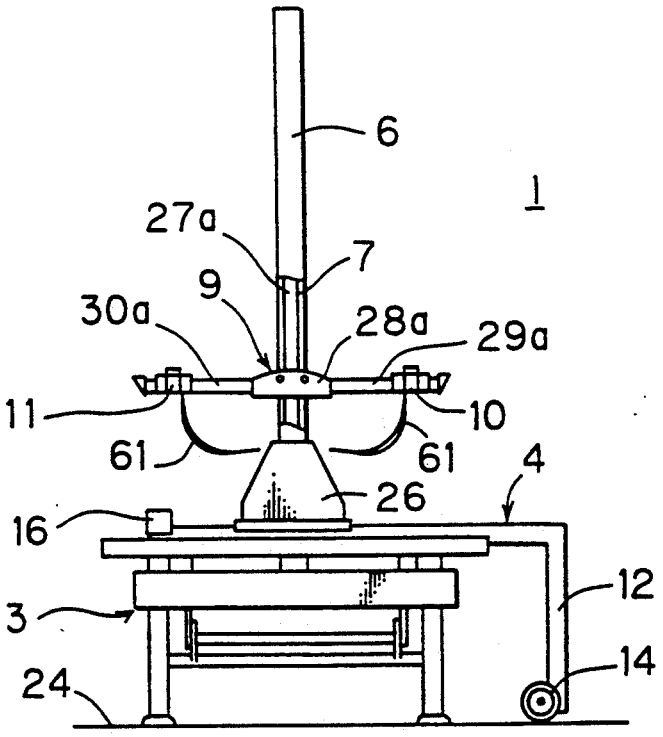
FIG. 3 is a left end elevational view of the bed apparatus shown in FIG. 1.
Figure 4:
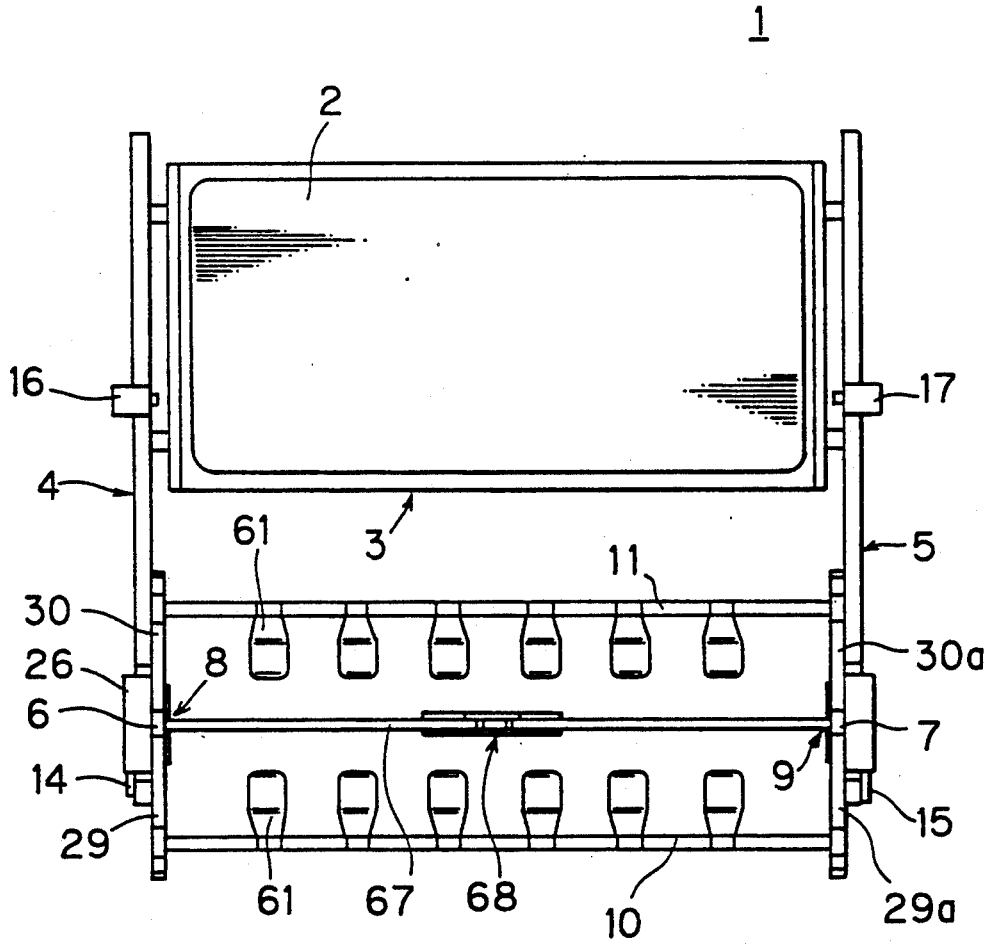
FIG. 4 is a plan view as in FIG. 2, however showing sliders in their most extended position laterally outside the bed body 3.
Figure 5:
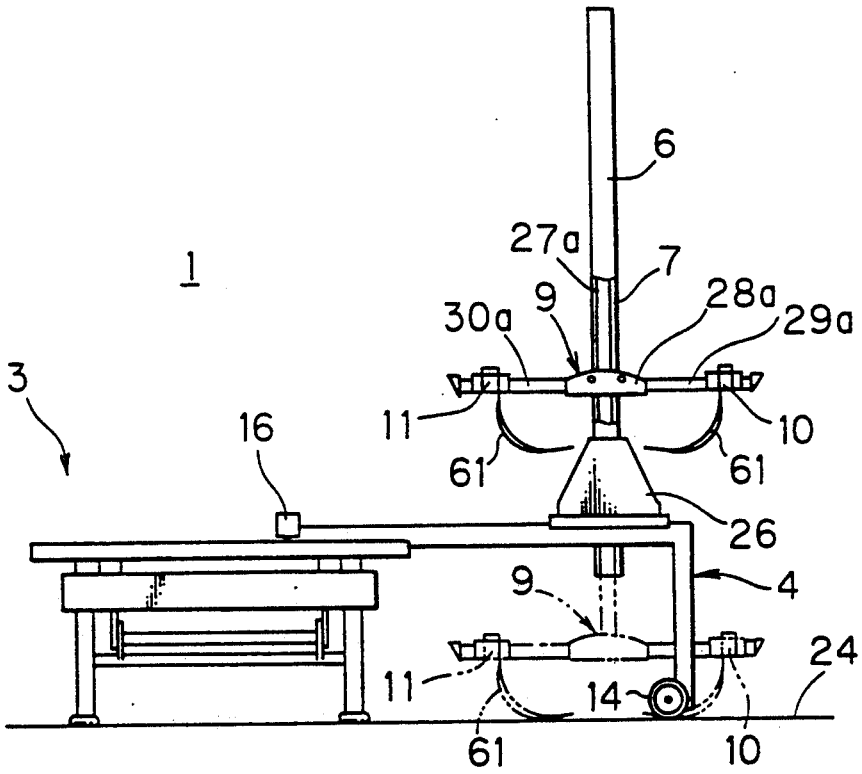
FIG. 5 is a left end elevational view as in FIG. 3, but showing the laterally extended state shown in FIG. 4.
Figure 6:
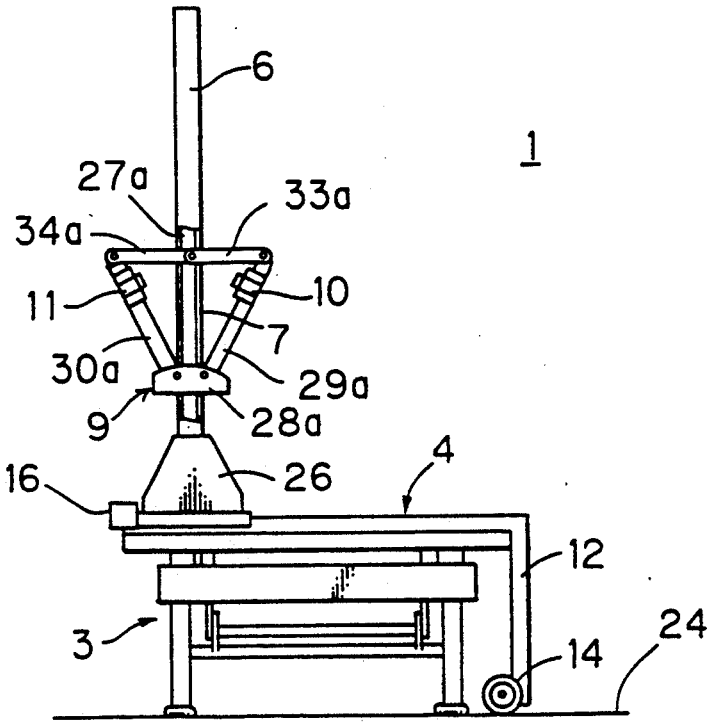
FIG. 6 is a left side elevational view as in FIG. 3, but showing the sliders in their most retracted position with respect to the bed body.

FIGS. 1 to 6 show the overall structure of the bed apparatus 1. FIGS. 1 to 3 show a first typical operational mode of the bed apparatus 1 and FIGS. 4 and 5 show a second typical operational mode thereof, while FIG. 6 shows a third typical operational mode of the bed apparatus 1. FIG. 1 is a front elevational view, FIGS. 2 and 4 are plan views, and FIGS. 3, 5 and 6 are left end elevational views respectively.

Figure 7:
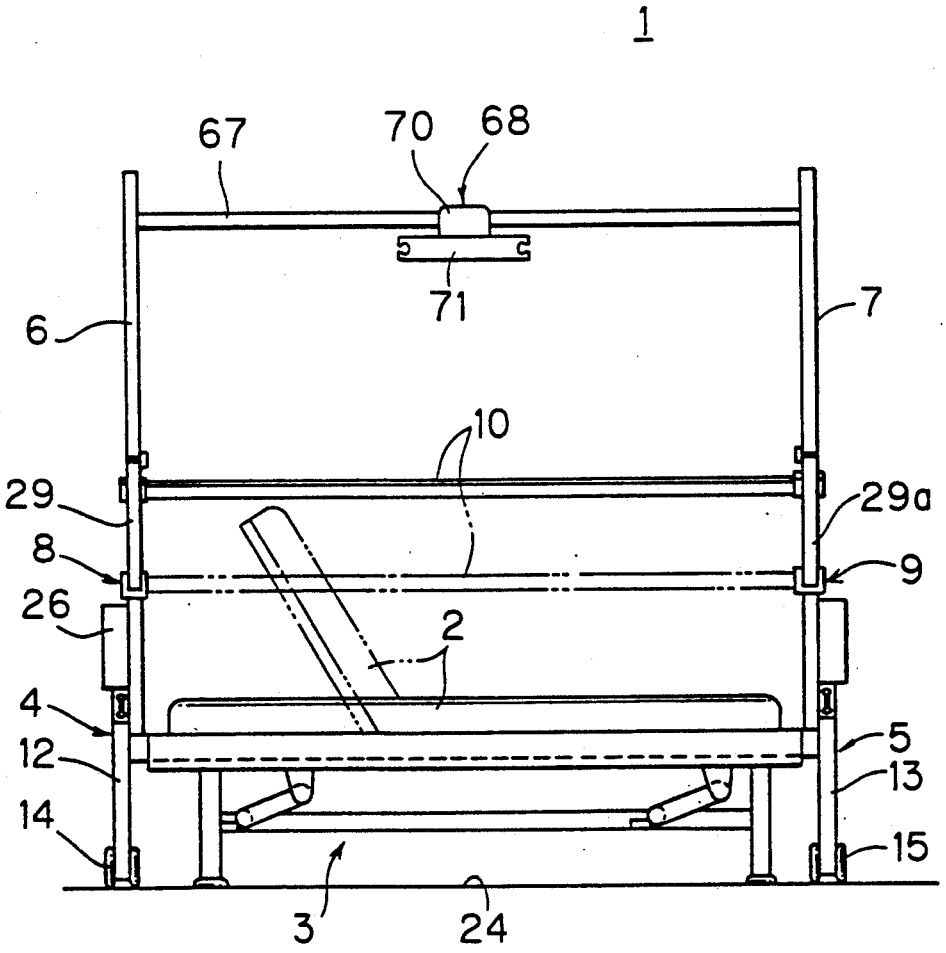
FIG. 7 is a front elevational view as in FIG. 1, showing a side bar moved upwardly following rotation of support arms for the side bar.

The bed apparatus 1 comprises a bed body 3 and a mattress 2 which is spread thereon. The bed body 3 is so hinged that it is possible to arbitrarily change a partially inclined state of the mattress 2. FIG. 7 shows a partially raised state of the mattress 2, with phantom lines.

A pair of sliders 4 and 5 is mounted on both end portions of the bed body 3, to be slideable in the cross direction of the bed body 3. The sliding movement enables the sliders 4 and 5 to extend in the cross direction of the bed body 3, as most clearly shown in FIGS. 4 and 5.

A pair of upright bars 6 and 7 is mounted to upwardly extend from the sliders 4 and 5 respectively.

A pair of support members 8 and 9 are mounted to be movable along the upright bars 6 and 7 respectively and stoppable at adjusted positions.

Two parallel side bars 10 and 11 are provided to couple the pair of support members 8 and 9 with each other.

The bed apparatus 1 is now described in more detail.

Figure 8:
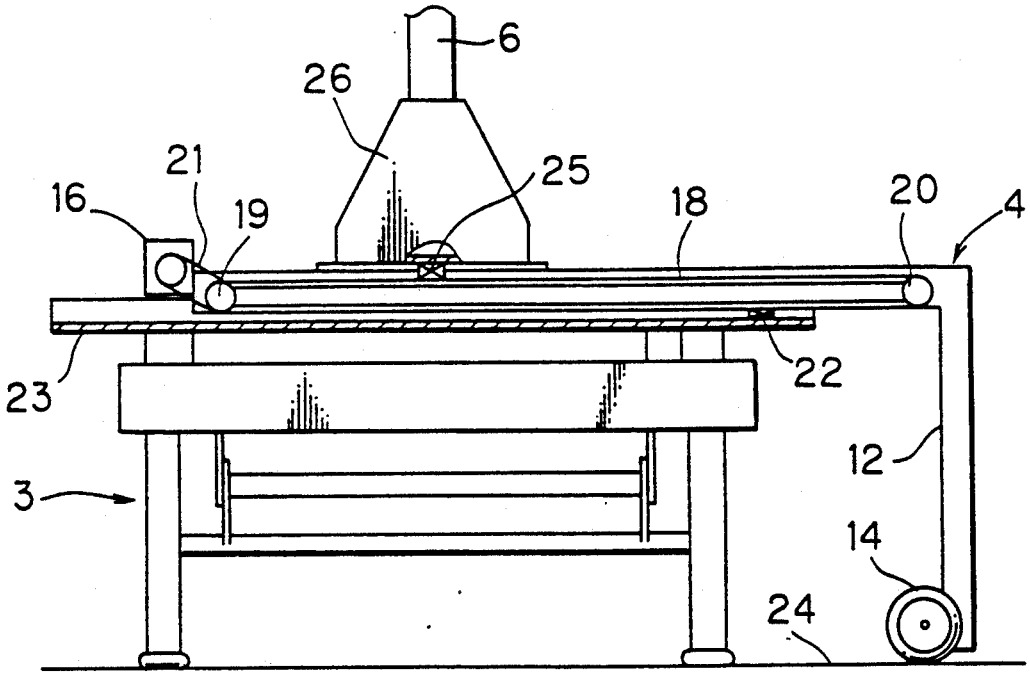
FIG. 8 is a left end elevational view as in FIG. 3, but showing a mechanism for sliding the slider crosswise to the bed body.
Figure 9:
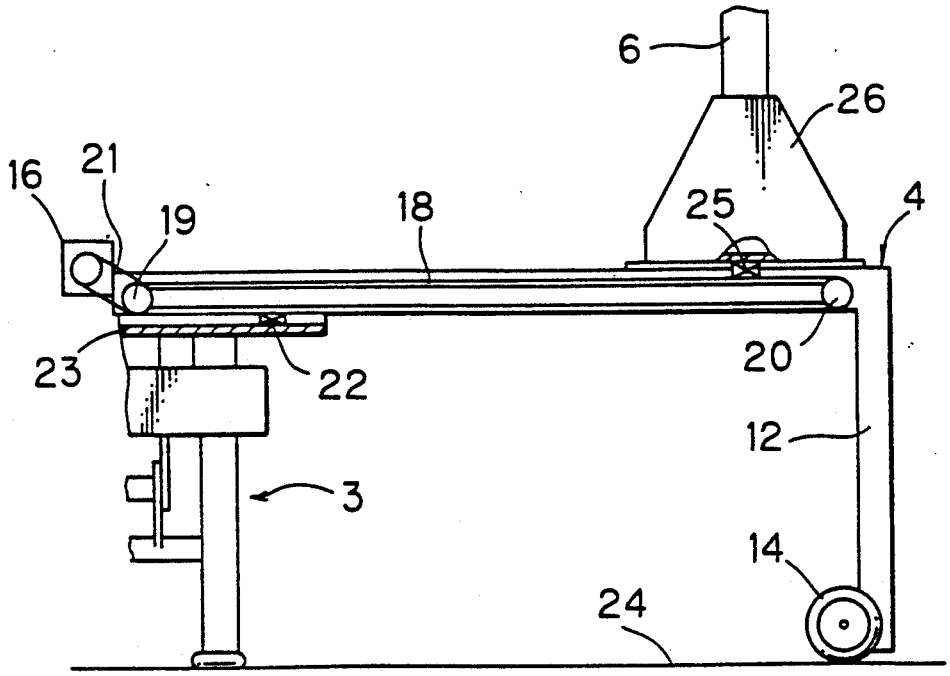
FIG. 9 is a left end elevational view similar to FIG. 5, but showing the mechanism of FIG. 8 in its most extended position.
Figure 10:
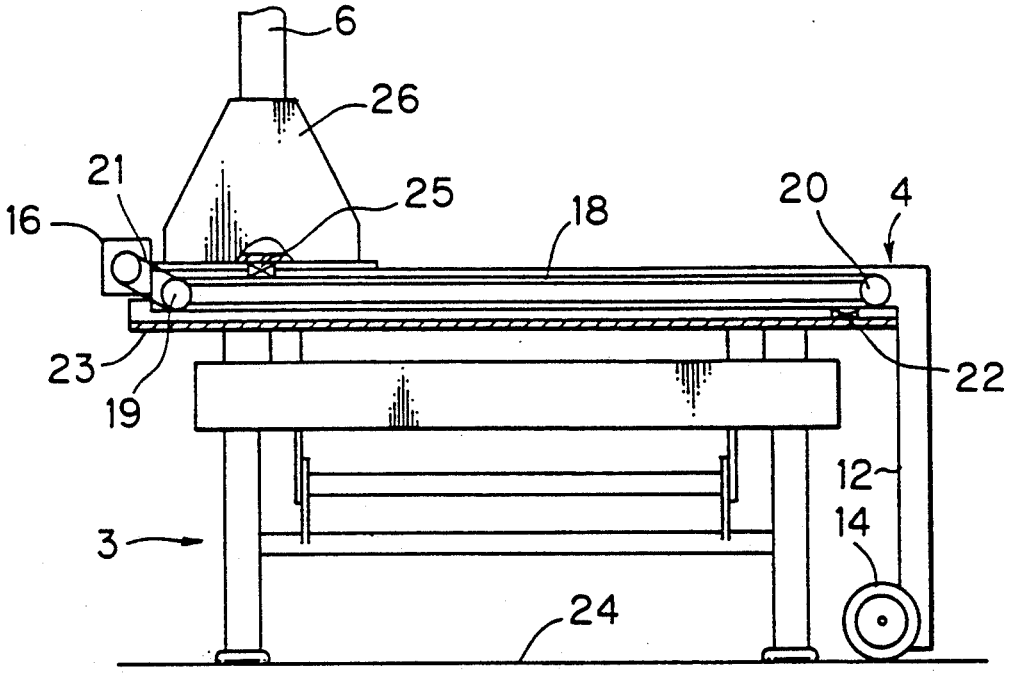
FIG. 10 is a left end elevational view as in FIG. 6, but showing the mechanism of FIG. 8 in its most retracted position.

First a structure for shifting the slider 4 or 5 along the cross direction of the bed body 3 will be described. FIGS. 8, 9 and 10, which correspond to FIGS. 3, 5 and 6 respectively, show the first slider 4. The second slider 5 has a structure which is substantially identical to that for the first slider 4. It is noted here that FIGS. 8 to 10 are partially fragmented or simplified, in order to facilitate the understanding of the operation of the slider 4.

The sliders 4 and 5, having L-shaped configurations as a whole, are provided with vertically extending leg portions 12 and 13 respectively. Wheels 14 and 15 are mounted to the lower ends of the leg portions 12 and 13 respectively.

The sliders 4 and 5 are driven by traverse motors 16 and 17, which are fixed to the sliders 4 and 5 respectively.

Referring specifically to FIGS. 8 to 10, the structure for driving the first slider 4 will now be described. According to this embodiment, the upright bar 6 moves along the slider 4 in response to a sliding movement of the slider 4.

For this purpose, chain 18 is arranged on a horizontally extending portion of the slider 4. The chain 18 may be replaced by a belt or the like. The chain 18 extends around sprocket wheels 19 and 20 mounted on the slider 4. Rotation of an output shaft of the motor 16 is transmitted to the first sprocket wheel 19 through a belt 21, for example.

A fixture 22 is fixed to a guide rail 23 in a prescribed position on a lower path for the chain 18. The guide rail 23 is secured to the bed body 3.

When the drive of the motor 16 is transmitted to the sprocket wheel 19 through the belt 21 and the chain 18 circulates in response, therefore, the slider 4 slides along the guide rail 23 since the lower path for the chain 18 is determined by the guide 23 through the fixture 22. The sliding direction of the slider 4 can be varied with the direction of rotation of the output shaft of the motor 16. In such sliding movement of the slider 4, the wheel 14 rolls on a floor 24.

Another fixture 25 is fixed to a base portion 26 of the upright bar 6 in a prescribed position on an upper path for the chain 18. When the chain 18 circulates in the aforementioned manner, therefore, the base portion 26 and with it the upright bar 6 are displaced along the slider 4, since the upper path for the chain 18 is fixed to the base portion 26 by the fixture 25.

When the slider 4 slides along the bed body 3, therefore, the upright bar 6 is displaced in the same direction on the slider 4. In this case, the amount of displacement of the slider 4 with respect to the bed body 3 is equal to that of the upright bar 6 with respect to the slider 4.

In the state shown in FIG. 8, the upright bar 6 is located at the cross-directional center of the bed body 3. In this state, the slider 4 is slightly laterally spaced from the bed body 3.

When the slider 4 extends maximally laterally outwardly from the bed body 3 as shown in FIG. 9, the upright bar 6 is brought into a position close to the leg portion 12 on the slider 4. Relative to the bed body 3, the upright bar 6 is displaced by an amount twice that of the slider 4. Thus, it is possible to sufficiently and laterally separate the upright bar 6 from the bed body 3 while reducing the amount of extension of the slider 4 from the bed body 3.

When the legs 12 of the slider 4 are moved still closer to the bed body 3 as shown in FIG. 10, from the state of FIG. 8, the upright bar 6 is brought into a position close to the motor 16 on the slider 4. As a result, the upright bar 6 is moved crosswise to the bed toward a side portion of the bed body 3. Movement of the slider 4 and bar 6 into the position shown in FIG. 10 is generally implemented when the aforementioned side bars 10 and 11 are not used for protecting the sick person or the like, who lies on the bed body 3, against contact with the side bars 10 and 11.

Figure 11:
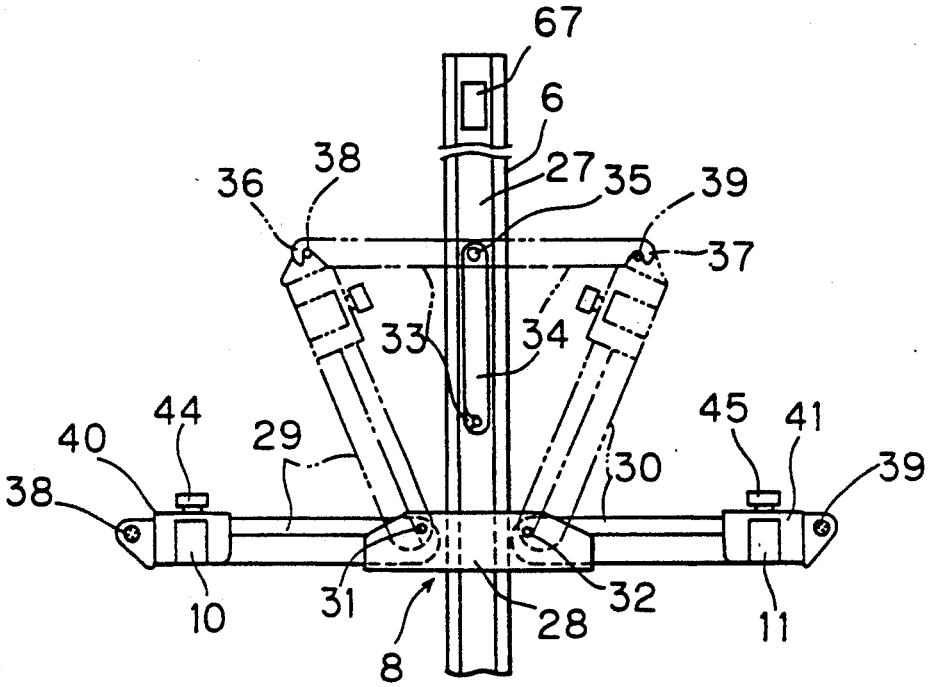
FIG. 11 is a right end elevational view, in the longitudinal bed direction, showing the structure of a support member.
Figure 12:
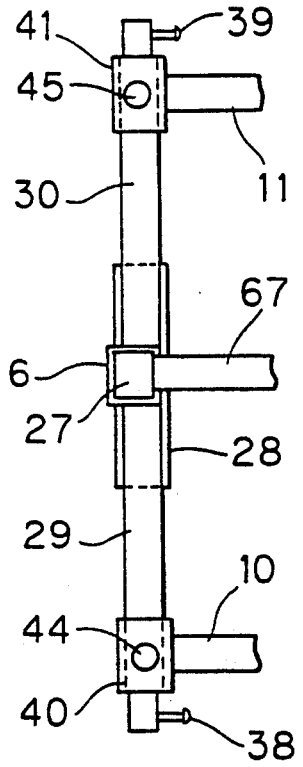
FIG. 12 is a plan view, vertically downwardly, showing the structure of the support member.
Figure 13:
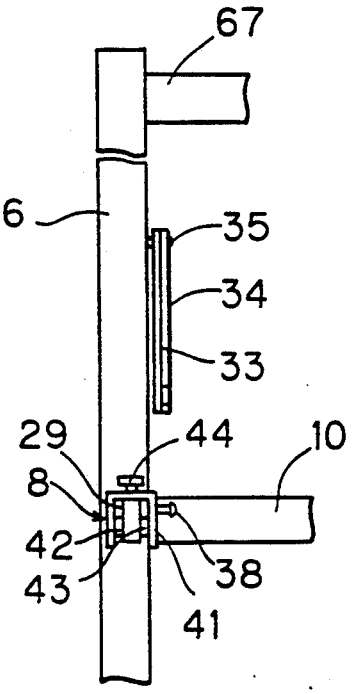
FIG. 13 is a front elevational view, in the direction cross-wise of the bed, showing the structure of the support member.

The structure of the support member 8 or 9 for the side bars 10, 11 will now be described in detail. The support members 8 and 9 are symmetrical in structure to each other. FIG. 11 is a right side elevational view showing the first support member 8, FIG. 12 is a plan view thereof, and FIG. 13 is a front elevational view of the support member 8, respectively.

Figure 14:
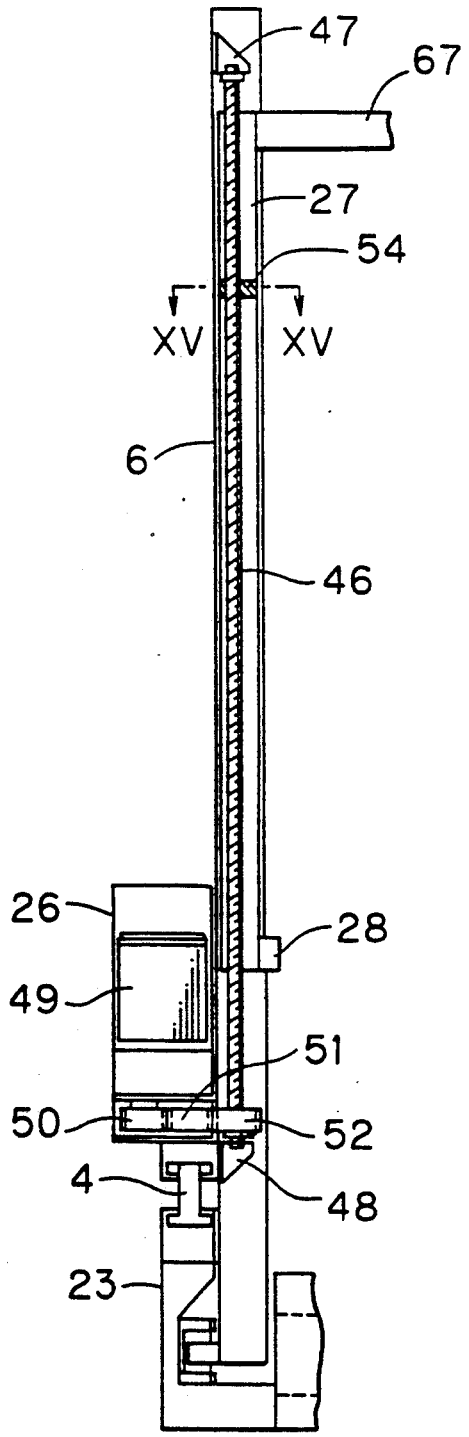
FIG. 14 is a longitudinal sectional view showing the relationship between a sliding block, which is included in the support member, and an upright member related thereto.
Figure 15:
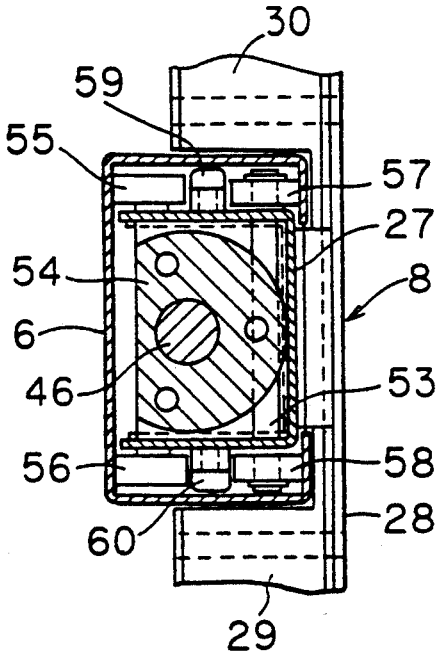
FIG. 15 is an enlarged sectional view taken along the line XV—XV in FIG. 14.

The support member 8 comprises a sliding block 27 which moves along the respective upright bar 6. The relationship between the sliding block 27 and the upright bar 6 will be described below with reference to FIGS. 14 and 15. A bracket 28 having a U-shaped section, for example, is fixed to the sliding block 27. This bracket 28 is also shown in FIG. 15, as described below. A pair of arms 29 and 30 are mounted on the bracket 28. These arms 30 and 29 are pivoted by pins 31, 32 to the bracket 28 along the cross direction of the bed body 3 on opposite sides of the bar 6.

As shown by phantom lines in FIG. 11, the arms 29 and 30 are rotatable about the pivot pins 31 and 32 relative to the bracket 28. Further, the sliding block 27 rotatably holds two hook links 33 and 34 by a common journal pin 35. Hook portions 36 and 37 are provided on respective free ends of the hook links 33 and 34. On the other hand, engaging pins 38 and 39, which are engageable with the hook portions 36 and 37 respectively, are provided on respective free ends of the arms 29 and 30. When the arms 29 and 30 are upwardly rotated as shown by phantom lines in FIG. 11, the hook portions 36 and 37 of the hook links 33 and 34 engage with the engaging pins 38 and 39 respectively, to hold the arms 29 and 30 in the upwardly rotated states.

The aforementioned two side bars 10 and 11 are mounted on the arms 29 and 30 respectively. Thus, the side bars 10 and 11 can be located at upper and lower positions, following the aforementioned rotation of the arms 29 and 30. FIG. 11 shows the lower and upper positions of the side bars 10 and 11 with solid and phantom lines. FIG. 6 shows a state corresponding to the state shown by the phantom lines in FIG. 11. The side bars 10 and 11 are thus brought into the upper positions to protect the sick person or the like, who is laid on the bed body 3, against injury, as well as to facilitate medical examination of the sick person or the like with no hindrance. Further, it is also possible to facilitate an operation for partially raising the bed body 3 as shown in FIG. 7, by bringing the side bars 10 and 11 to the upper positions as shown by the phantom lines in FIG. 11.

While FIGS. 11 to 13 show a structure which is related to the first support member 8, FIGS. 1 to 7 show the second support member 9. Elements of the second support member 9 which are in laterally symmetrical positions with respect to those included in the first support member 8, are denoted by the same reference numerals as shown in FIGS. 11 to 13 with subscripts "a", to avoid a redundant description.

According to this embodiment, the positions of the side bars 10 and 11 are changeable on the arms 29, **29*a*, 30 and 30*a*. As to the relationship between the arms 29 and 30 and the side bars 10 and 11 shown in FIGS. 11 to 13, clamps 40 and 41 having inverted U-shaped sections are mounted on respective end portions of the side bars 10 and 11. On the other hand, the arms 29 and 30 have T-shaped sections. Further, guide blocks 42 and 43 for holding lower portions of the arms 29 and 30 having the T-shaped sections, are mounted on the clamps 40 and 41, as shown in FIG. 13 with reference to the clamp 40. Thus, the clamps 40 and 41, which are longitudinally movable along the arms 29 and 30, are inhibited against sideward displacement relative to the arms 29 and 30. The clamps 40 and 41 are provided with clamp screws 44 and 45 respectively. These clamp screws 44 and 45** are tightened for fixing the positions of the clamps 40 and 41 on the arms 29 and 30.

The aforementioned structure is also employed on the other ends of the side bars 10 and 11 respectively.

Thus, the distance between the pair of side bars 10 and 11 can be varied with the positions of the side bars 10 and 11 relative to the arms 29 and 30. For example, the distance between the side bars 10 and 11 shown in FIG. 2 is wider than that shown in FIG. 4. The distance between the side bars 10 and 11 is thus changed in response to the physical constitution of the sick person or the like, for example, as described below. A structure for moving the support member 8 or 9 along the upright bar 6 or 7 and for holding the support members 8, 9 in an adjusted position, will now be described. FIG. 14 is a longitudinal sectional view showing the relationship between the sliding block 27 which is included in the first support member 8 and the related upright bar 6. FIG. 15 is an enlarged sectional view taken along the line XV—XV in FIG. 14. The relationship between the sliding block 27*a* which is secured to the second support member 9, and the upright bar 7 involves a structure (not shown) which is symmetrical to that shown in FIGS. 14 and 15. Therefore, only the relationship between the sliding block 27 which is secured to the first support member 8 and the related upright bar 6, is described in detail.

Referring to FIGS. 14 and 15, the upright bar 6 has a C-shaped section, in order to receive the sliding block 27 and to enable the mounting of the bracket 28 (FIG. 15) on the sliding block 27. A lead screw 46 is arranged in the upright bar 6, to be rotatable about its central axis. FIG. 14 shows brackets 47 and 48 for rotatably mounting both ends of the lead screw 46.

The aforementioned base portion 26 of the upright bar 6 has a hollow structure, to contain a motor 49 for driving the vertical movement of the sliding block 27. The motor 49 has a shaft rotatable in one or the opposite direction. Rotation of the shaft of the motor 49 is transmitted to the lead screw 46 through gears 50, 51, and 52.

A nut or screw block 54 with a female threading is fixed to the sliding block 27 through a mounting plate 53. The female threading of the nut or screw block 54 engages the lead screw 46. When the lead screw 46 is driven by the motor 49, the sliding block 27 is moved vertically. When the motor 49 is stopped on the other hand, the lead screw 46 is also stopped so that it is impossible to transmit a driving force from the female screw block 54 to the lead screw 46, whereby the sliding block 27 is held in its adjusted position by the stoppage of the lead screw 46.

FIG. 15 shows the elements for smoothly guiding the movement of the sliding block 27 along the upright bar 6. A plurality of rotatable guide rollers 55, 56, 57 and 58 and guide shoes 59 and 60 are provided on the sliding block 27. The guide rollers 55 to 58 and the guide shoes 59 and 60 come into contact with the inner surface of the upright bar 6 from various directions, thereby facilitating smooth vertical movement of the sliding block 27 within the upright bar 6.

Although FIG. 15 shows four guide rollers 55 to 58 and two guide shoes 59 and 60, appropriate numbers of such guide rollers and guide shoes (not shown) may be vertically distributed along the sliding block 27.

The bracket 28 is mounted on the lower end of the sliding block 27. The lower end of the sliding block 27 is movable to project downwardly from the upright bar 6 beyond the gear 52 and the lower end of the upright bar 6. Thus, the support member 8 or 9, can be brought to a level below the bed surface as shown by phantom lines in FIG. 5.

FIGS. 1 to 5 illustrate the appropriate numbers of hanger members 61, which are provided on the side bars 10 and 11 respectively. These hanger members 61 are adapted to raise the sick person or the like in a lying condition. FIGS. 16 to 19 show the structure of each such hanger member 61 in detail.

Figure 16:
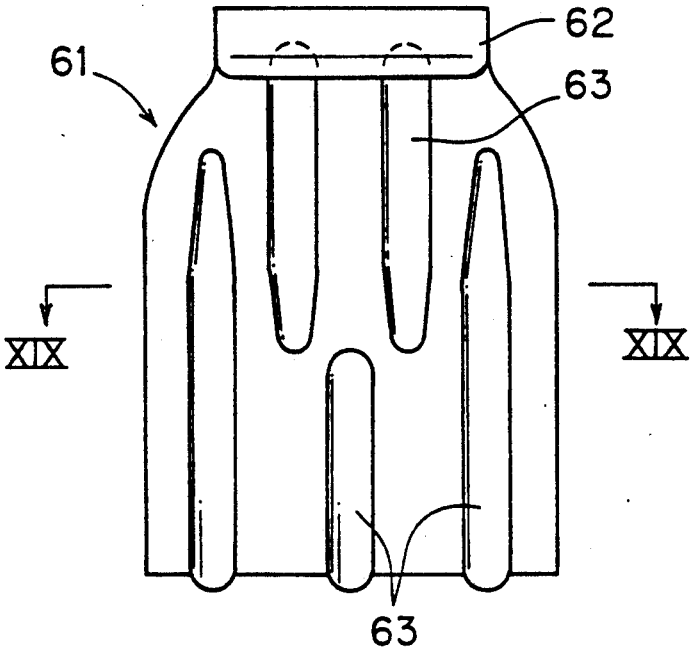
FIG. 16 is a front elevational view showing a hanger member.
Figure 17:
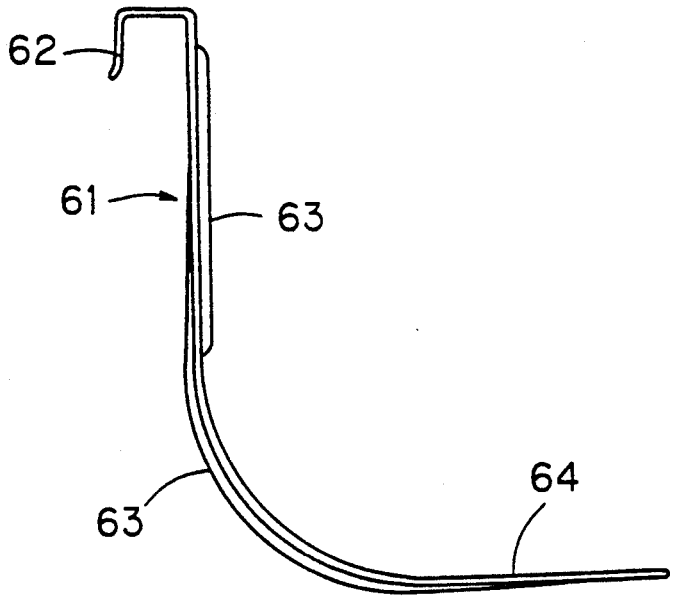
FIG. 17 is a right side elevational view showing the hanger member.
Figure 18:
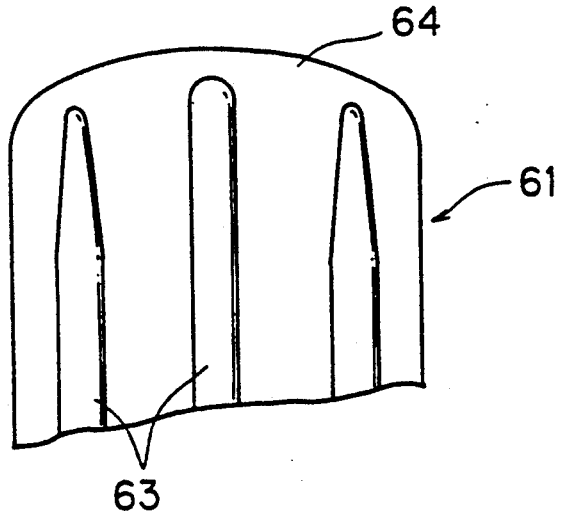
FIG. 18 is a plan view partially showing the hanger member.
Figure 19:
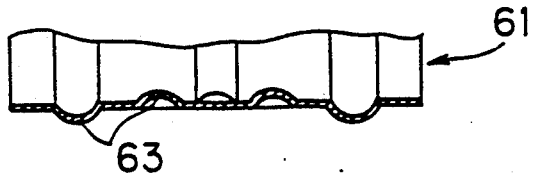
FIG. 19 is a sectional view taken along the line XIX—XIX in FIG. 16.

FIG. 16 is a front elevational view showing the hanger member 61 and FIG. 17 is a right side elevational view thereof, while FIG. 18 is a plan view partially showing the hanger member 61, and FIG. 19 is a sectional view taken along the line XIX—XIX in FIG. 16.

The hanger member 61 is formed of a relatively rigid material such as hard plastic, aluminum or stainless steel, for example. The hanger member 61 is curved to provide an L-shaped configuration as a whole, and provided with a hook portion 62, which is engageable with the side bar 10 or 11, on its one end. A plurality of ribs 63 are distributed on the hanger member 61, in order to ensure at least a prescribed level of strength while reducing the thickness as well as the weight of the hanger member 61. As clearly shown in FIG. 19, such ribs 63 are preferably formed to provide rounded sections.

A plurality of hanger members 61 is arranged along the side bars 10, 11. In operation, horizontally extending bottom portions 64 of the hanger members 61 are inserted under the body of the sick person or the like who is lying on the bed body 3. The hanger members 61 are appropriately distributed on both sides of the body of the sick person or the like in consideration of the weight of the sick person or the like. On the other hand, the height of and the distance between the side bars 10 and 11 are adjusted by means of the aforementioned mechanism with reference to the positions of the hook portions 62 of the hanger shovels 61. Then, the hook portions 62 of the hanger members 61 are engaged with the slide bars 10 and 11.

The aforementioned hanger members 61 can be advantageously inserted under the body of the sick person or the like, without raising the person. After the hook portions 62 of the hanger members 61 engage the side bars 10 and 11, the side bars 10 and 11 are so displaced that it is possible to move the sick person or the like to a desired position.

Typical operational states of the present bed apparatus 1 will now be described with reference to FIGS. 1 to 6.

When the sliders 4 and 5 and the upright bars 6 and 7 are in the states shown in FIGS. 1 to 3, the sick person or the like who is lying on the bed body 3 is raised. The support members 8 and 9 and the side bars 10 and 11 are moved downwardly from the states shown in FIGS. 1 to 3, to positions engageable with the hook portions 62 of the hanger members 61, which have been inserted under the body of the sick person or the like. Further, the distance between the pair of side bars 10 and 11 is adjusted with due regard to the physical constitution of the sick person or the like. This distance needs to be adjusted only once in an initial stage of use of the bed apparatus 1.

Then, the support members 8 and 9 and the side bars 10 and 11 are displaced upwardly to such positions that the hanger members 61 are separated from the mattress 2 on the bed body 3.

A bed sheet or the like, which is spread on the mattress 2, may be exchanged in this state, and the bed apparatus 1 may be returned to its original state after such an exchange.

Moving a sick person or the like from the bed body 3 to a position laterally next to the bed for bathing the person, for example, will now be described.

In this case, the sliders 4 and 5 are extended laterally from the bed body 3, as shown in FIGS. 4 and 5, when the sick person or the like is moved laterally from the bed body 3 at the same level as the bed surface.

Then, the support members 8 and 9 and the side bars 10 and 11 are moved downwardly, whereby the sick person is moved downwardly along the side of the bed body 3. This embodiment is so constructed that the support members 8 and 9 can be moved downwardly to bring the sick person or the like into contact with the floor 24, as shown by phantom lines in FIG. 5. The sick person or the like thus placed on the floor 24 is then brought into a bathtub for bathing.

In the state shown in FIGS. 4 and 5, the vertical positions for stopping the support members 8 and 9 may be selected in response to the type of care needed for the sick person or the like. For example, it may not be desirable to place the sick person or the like temporarily on the floor 24. Rather, a bathtub may be arranged immediately under the side bars 10 and 11 in the state shown in FIGS. 4 and 5, so that the sick person or the like can be brought into the bathtub in an intermediate stage of downward movement of the side bars 10 and 11.

An operation reverse to the above may be carried out in order to return the sick person or the like onto the bed body 3.

When the support members 8 and 9 and the side bars 10 and 11 are not used, as shown in FIG. 6, it is preferable to cause the sliders 4 and 5 to slide further toward the bed body 3 while moving the upright bars 6 and 7 toward an end along the cross direction of the bed body 3. More preferably, the arms 29*a* and 30*a* (and 29 and 30) are fixed in upwardly rotated states, to raise up the vertical positions of the side bars 10 and 11.

The present bed apparatus 1 having such a lifting mechanism, is further provided with a mechanism for rehabilitation.

FIGS. 1, 2, 4 and 7 illustrate a rail 67 which extends across the pair of upright bars 6 and 7. As shown in FIGS. 11 to 14, each end of the rail 67 is fixed to the sliding block 27 or 27*a* connected to the support member 8 or 9. This rail 67 is positioned above the two side bars 10 and 11, and its vertical position is changeable following vertical movement of the sliding blocks 27 and 27*a* along the upright bars 6 and 7.

Figure 20:
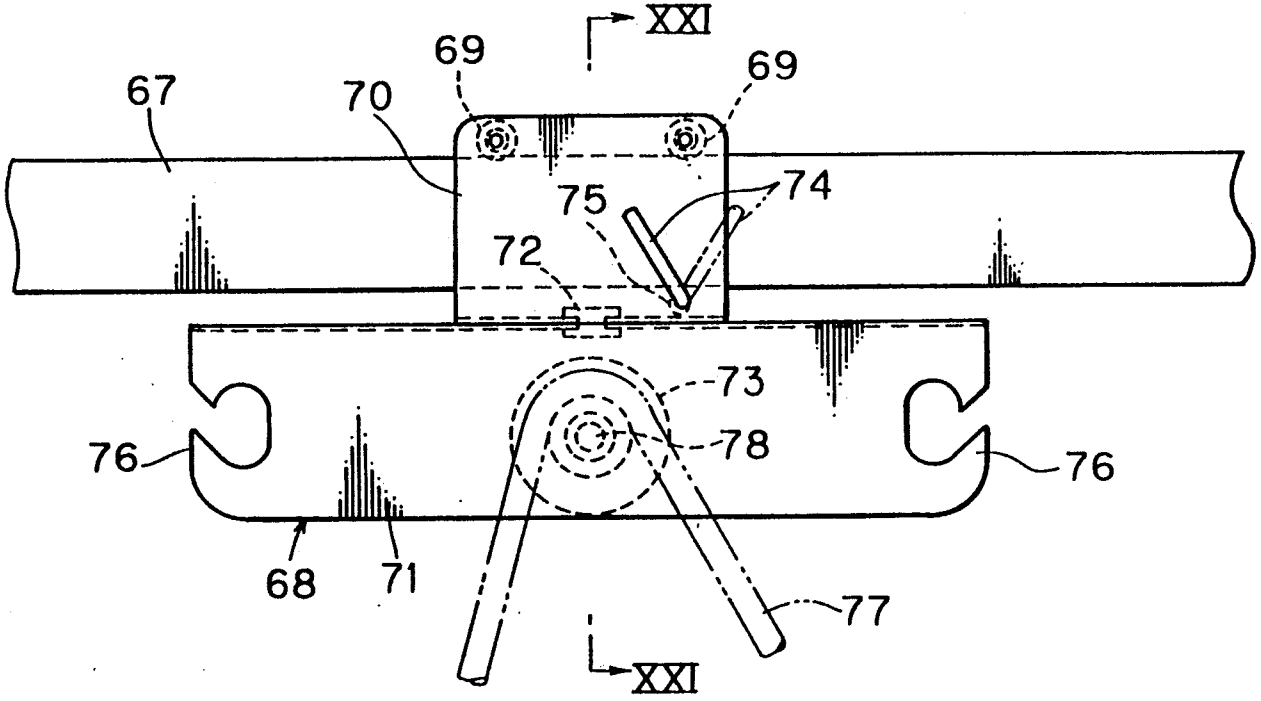
FIG. 20 is a front elevational view showing a rehabilitation attachment on an enlarged scale.
Figure 21:
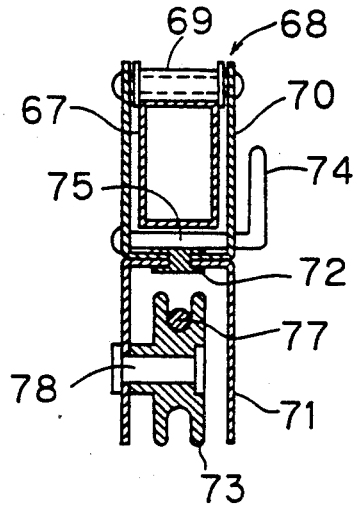
FIG. 21 is a sectional view taken along the line XXI—XXI in FIG. 20.
Figure 22:
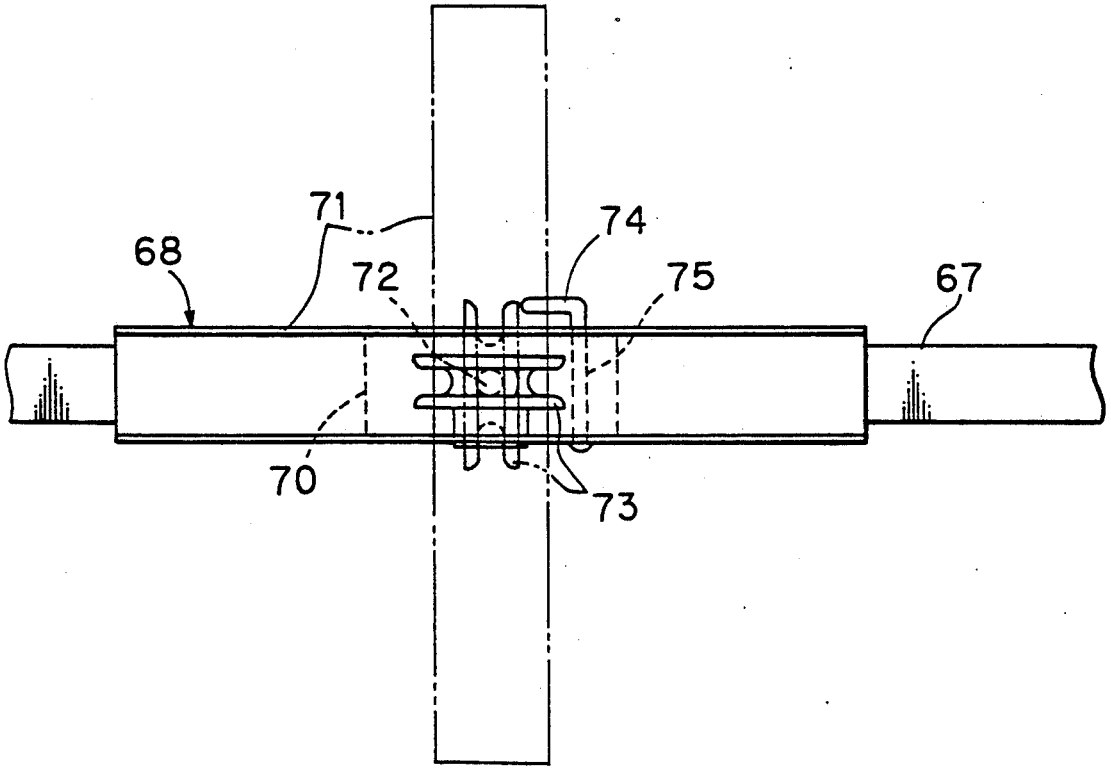
FIG. 22 is a bottom plan view of the attachment shown in FIG. 20.

A rehabilitation attachment 68 is movably secured to the rail 67. FIGS. 20 to 22 illustrate this attachment 68 on an enlarged scale. FIG. 20 is a front elevational view showing the attachment 68, FIG. 21 is a sectional view taken along the line XXI—XXI in FIG. 20, and FIG. 22 is a bottom plan view showing the attachment 68.

The attachment 68 comprises, for example, two wheels 69 which roll on the rail 67. These wheels 69 are rotatably mounted to an upper yoke 70. A lower yoke 71 is located under the upper yoke 70 and secured thereto by a rivet 72 which permits rotation of the lower yoke 71 about a vertical axis with respect to the upper yoke 70. The lower yoke 71 rotatably holds a pulley 73.

The upper yoke 70 may be provided with a mechanism for securing the attachment 68 to the rail 67 as needed. Such a mechanism is provided by a brake lever 74, for example, so that an eccentric shaft 75 connected to the lever 74 clamps the rail 67 between the eccentric shaft 75 and the wheels 69 when the brake lever 74 is rotated into the phantom line position shown in FIG. 20, thereby fixing the attachment 68 in a prescribed position on the rail 67.

The lower yoke 71 is preferably provided with hooks 76 at both end portions thereof. A method of using the hooks 76 is described below with reference to FIG. 25.

For the purpose of rehabilitation, a rope 77 is extended around the pulley 73 as shown by phantom lines in FIG. 20, for example.

As clearly shown in FIG. 21, a shaft 78 rotatably supporting the pulley 73, is cantilevered from the left wall of the lower yoke 71, whereby the rope 77 can be easily mounted on or detached from the pulley 73 through the gap between the pulley 73 and the right wall of the yoke 71.

FIG. 23 shows a sick person 100 or the like, who performs hand and arm exercises while lying down. Hand grips 79 and 80 are secured to both ends of the rope 77. As shown in FIG. 23, the sick person 100 or the like grasps the hand grips 79 and 80 with his left and right hands 81 and 82 and alternately moves the hands 81 and 82 and arms up and down to perform the exercise. Referring to FIG. 23, the direction of the pulley 73 is changed following the direction of extension of the rope 77, whereby the longitudinal direction of the lower yoke 71 is perpendicular to the rail 67.

FIG. 24 shows the sick person 100 or the like while exercising the arms and legs.

An end of the rope 77 is connected to belt 85, which can be looped around both feet 83 and 84 of the sick person 100 or the like. The other end of the rope 77 is provided with a hand grip 86 to be grasped by the hands 81 and 82 of the sick person 100 or the like. The sick person 100 or the like places his feet 83 and 84 into the loop formed by the belt 85 and grasps the hand grip 86 with his hands 81 and 82 and moves the hands 81 and 82, to raise or lower his feet 83 and 84. Thus, the sick person 100 or the like can exercise arms and legs simultaneously. The sick person 100 or the like can arbitrarily engage only one of the feet 83 and 84, or grasp the hand grip 86 with only one hand 81 or 82, to perform the exercise.

Referring to FIG. 24, the angle of the pulley 73 is changed following the direction of extension of the rope 77, whereby the longitudinal direction of the lower yoke 71 extends in parallel to the rail 67.

The position of the exercise attachment 68 along the rail 67 shown in FIG. 23 is different from that for the exercise shown in FIG. 24. The wheels 69 roll on the rail 67 to achieve the positional change. While the sick person 100 or the like exercises, however, it is not necessary to move the attachment 68 along the rail 67. Therefore, the attachment 68 may be temporarily fixed to the rail 67 by the eccentric shaft 75 operated by the brake lever 74. Further, additional means (not shown) may be provided for selectively inhibiting the lower yoke 71 from rotation with respect to the upper yoke 70.

The vertical position of the rail 67 can be adjusted in a stepless manner following vertical movement of the sliding blocks 27 and 27*a*. Thus, the vertical position of the attachment 68 can also be adjusted in a stepless manner. Therefore, it is easy to properly select the vertical position or elevation of the attachment 68 in accordance with the physical constitution or the condition of the sick person 100 or the like, who will exercise as shown in FIG. 23 or 24. The attachment 68 may be vertically raised or lowered by the motor 49, for facilitating hand or limb exercises. Such exercise is advantageously applied when the sick person 100 or the like cannot move his hands and/or feet unaided.

Figure 25:
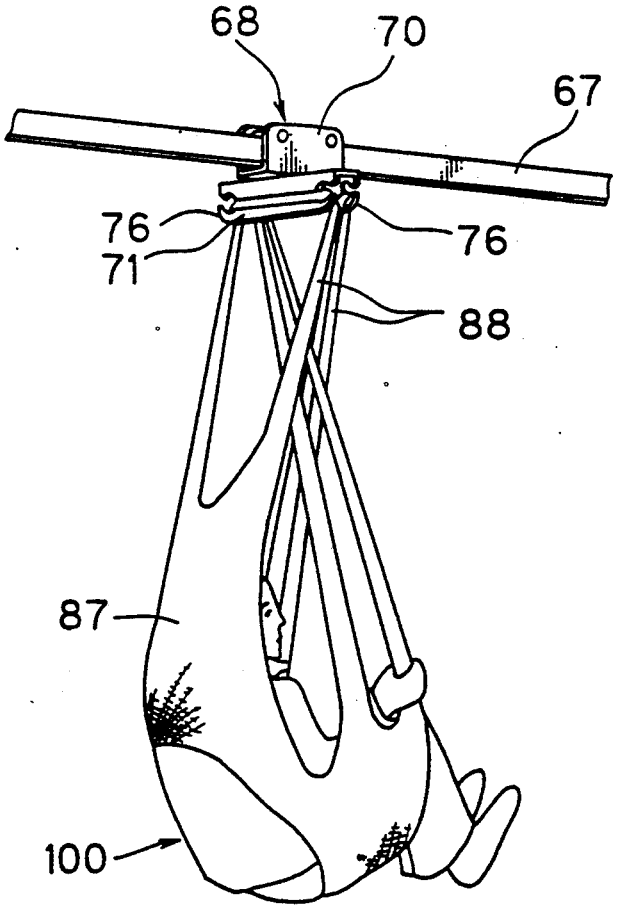
FIG. 25 is a perspective view showing the sick person or the like who is lifted by a hammock.

The attachment 68 can also be used for suspending a hammock 87, as shown in FIG. 25. The hammock 87 is adapted to lift the sick person 100 or the like in a sitting state for relieving himself or moving the person onto a wheelchair, for example. Belt portions 88 of the hammock 87 are engaged with the hooks 76 on the lower yoke 71. The lower yoke 71 has a relatively long configuration so that it is possible to relatively increase the distance between the hooks 76 on its end portions, whereby the hammock 87 is not twisted on its upper portion. Thus, it is possible to prevent at least to some extent, that the sick person 100 or the like is cramped in when held by the hammock 87.

FIGS. 26 and 27 illustrate the sick person 100 or the like while exercising by walking. In this case, the bed apparatus 1 is brought into the following state:

First, the pair of sliders 4 and 5 slide out to extend in the cross direction of the bed body 3, as shown in FIGS. 26 and 27. According to this embodiment, the pair of upright bars 6 and 7 is also moved in the same direction by the aforementioned mechanism. This extended state corresponds to that shown in FIGS. 4 and 5.

The positions of the pair of support members 8 and 9 are adjusted on the upright bars 6 and 7 with the aid of the aforementioned mechanism. Thus, the vertical positions of the two parallel side bars 10 and 11 are adjusted to those optimal for the situation or the physical constitution of the sick person 100 or the like who will exercise by walking alongside the bed.

Further, the distance between the side bars 10 and 11 may also be adjusted with the aid of the aforementioned mechanism.

The hanger members 61 (FIG. 2, for example) are removed from the side bars 10 and 11.

Upon such adjustment, the sick person 100 or the like stands between the two side bars 10 and 11 and grasps the same with the hands for an exercise walk. In this case, the hammock 87 shown in FIG. 25 may be suspended from the attachment 68 to hold the sick person 100 or the like, who will exercise by walking. Thus, the sick person 100 or the like can put out his feet from the hammock 87 and move them on the floor 24 in a walking manner.

When the sick person 100 or the like gets tired during such walking exercise, he can take a seat on a chair. Such a chair may be provided by a stool type movable chamber pot, for example.

Although the present invention has been described and illustrated in detail, it is clearly understood that the same is by way of illustration and example only and is not to be taken by way of limitation, the scope of the present invention being limited only by the terms of the appended claims.

What is claimed is:

1. A bed apparatus comprising: a bed body having a longitudinal dimension and a cross-directional dimension; a pair of sliders mounted on both end portions of said bed body for sliding along the cross direction of said bed body and extending in the cross direction of said bed body; a pair of upright bars mounted on said sliders to upwardly extend from said sliders; a pair of support members mounted for movement along said upright bars and stoppable at adjusted positions; a pair of parallel side bars coupling said pair of support members with each other; a rail coupling said pair of support members with each other, said coupling rail being positioned above said pair of side bars; and a rehabilitation attachment movable along said rail and comprising a pulley having an effective angle changeable about a vertical axis.

2. The bed apparatus of claim 1, wherein said rehabilitation attachment comprises wheel means rolling along said coupling rail; an upper yoke rotatably holding said wheel means; vertical journal means forming said vertical axis, a lower yoke mounted to be rotatable about said vertical axis relative to said upper yoke; and means for rotatably mounting said pulley in said lower yoke.

3. The bed apparatus of claim 2, wherein said rehabilitation attachment further comprises means for fixing said upper yoke to said coupling rail in any desired position along said coupling rail.

4. The bed apparatus of claim 2, wherein said lower yoke comprises hooks.

5. The bed apparatus of claim 2, wherein said lower yoke comprises a pair of walls opposite to each other with a prescribed space, and wherein said mounting means for rotatably mounting said pulley comprise a shaft which is mounted on one of said walls.

* * * * *